US007296525B2

(12) United States Patent
Cho

(10) Patent No.: US 7,296,525 B2
(45) Date of Patent: Nov. 20, 2007

(54) PRESSER FOOT AND SEWING MACHINE USING THE SAME

(75) Inventor: Byoung-Woo Cho, Yongin (KR)

(73) Assignee: Yupoong, Inc., Seoul (KR)

( * ) Notice: Subject to any disclaimer, the term of this patent is extended or adjusted under 35 U.S.C. 154(b) by 56 days.

(21) Appl. No.: 11/270,584

(22) Filed: Nov. 10, 2005

(65) Prior Publication Data

US 2006/0260524 A1 Nov. 23, 2006

(30) Foreign Application Priority Data

May 19, 2005 (KR) ..... 10-2005-0042105
Jul. 18, 2005 (KR) ..... 10-2005-0064924

(51) Int. Cl.
*D05B 71/04* (2006.01)
*D05B 29/00* (2006.01)

(52) U.S. Cl. ..... 112/281; 112/235

(58) Field of Classification Search ..... 112/280, 112/281, 235, 240, 220, 227
See application file for complete search history.

(56) References Cited

U.S. PATENT DOCUMENTS 2,457,362 A * 12/1948 Giglio ..... 112/281
3,611,958 A * 10/1971 Rutledge ..... 112/80.71
3,614,935 A * 10/1971 Conti ..... 112/286
4,305,339 A * 12/1981 Inglis ..... 112/281
4,562,783 A * 1/1986 McClellan ..... 112/281
5,960,729 A * 10/1999 Matsumoto et al. ..... 112/235
6,273,013 B1 * 8/2001 Carey, Jr. ..... 112/117
6,332,417 B1 * 12/2001 Vornholt ..... 112/222

FOREIGN PATENT DOCUMENTS

KR 1998-065809 12/1998

* cited by examiner

*Primary Examiner*—Ismael Izaguirre
(74) *Attorney, Agent, or Firm*—Staas & Halsey LLP

(57) ABSTRACT

A sewn product is protected from being stained by melted leavings of a work material by cooling a needle moving at a high speed, and thus the quality of the product may be enhanced when the work material is sewed by a presser foot of the present invention, and a sewing machine using the same, wherein the presser foot is provided with a fluid line for injecting a fluid toward the needle.

16 Claims, 10 Drawing Sheets

PRESSER FOOT AND SEWING MACHINE USING THE SAME

CROSS-REFERENCE TO RELATED APPLICATION

This application claims priority to and the benefit of Korean Patent Application No. 10-2005-0042105 filed in the Korean Intellectual Property Office on May 19, 2005, and Korean Patent Application No. 10-2005-0064924 filed in the Korean Intellectual Property Office on Jul. 18, 2005, the entire contents of which are incorporated herein by reference.

BACKGROUND OF THE INVENTION (a) Field of the Invention

The present invention relates to a presser foot and a sewing machine using the same. More particularly, the present invention relates to a presser foot and a sewing machine using the same for home or industrial use having an advantage of producing an enhanced quality of the final sewed product by preventing damage and/or a defect thereof by rapidly cooling a needle moving at a high speed.

(b) Description of the Related Art

Typically, a sewing machine is an apparatus for sewing materials such as leathers, clothes, papers, etc. Such a sewing machine includes a head installed with a sewing mechanism, a table for sewing a work material (e.g., clothes) thereon, and a driving apparatus (e.g., a motor) that produces power for the sewing machine. The head is installed with, for example, a needle bar holding a needle and moving up and down with the needle, a shuttle race cross-engaging upper and lower threads for each back and forth movement of the needle, a thread take-up device pulling the upper thread up to above the work material in accordance with the lower thread when the cross-engagement with the lower thread is finished, and a feed dog mechanism feeding the work material.

The needle of the sewing machine vertically moves at a very high speed for sewing a work material, and the needle is subjected to a high heat produced by friction with the work material. In more detail, according to a conventional sewing machine, the work material may be locally melted by the needle heated to a high temperature by the friction, especially when the work material being sewn is formed of a thermally weak material. In this case, the melted bit of the work material may stick to the needle and come out of the work material with the movement of the needle, such that the surface of the work material may become dotted with leavings of the melted bits solidified thereon, thereby producing defects of the sewed product.

In a more specific example, when a cap is manufactured with a visor core made of a synthetic resin material, the visor core, which is thermally weak, is locally melted by the needle heated to a high temperature, and melted bits thereof come out of the cap such that the surface of the cap may be stained with the leavings of the melted bits of the synthetic resin. Such leavings may not be easily blown off by highly pressurized air, and thus defective products may finally be produced.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a presser foot and a sewing machine using the same having advantages of enhancing quality of sewn products by preventing leavings of a work material from staining the sewn products by cooling a needle moving at a high speed.

An exemplary presser foot according to an embodiment of the present invention includes a body having a needle hole providing a passage for a needle, a fixing member formed at the body and configured to combine with a sewing machine, and a fluid line formed at the body for injecting a fluid toward the needle.

Another exemplary presser foot according to an embodiment of the present invention includes a body configured to combine with a sewing machine and having a needle hole providing a passage for a needle, and a fluid line formed at the body for injecting a fluid toward the needle.

In a further embodiment, the fluid line includes a fluid supply passage and a fluid exhaust passage. The fluid supply passage is formed in a length direction at the body and is configured to be connected with a fluid supply device to receive the fluid. The fluid exhaust passage is connected with the fluid supply passage and exhausts the fluid via the needle hole of the body.

An exemplary sewing machine according to an embodiment of the present invention includes a fluid supply device, an on/off valve connected with the fluid supply device through a line member, a switch operating the on/off valve, and a presser foot connected with the on/off valve to receive a fluid therefrom and having a fluid line formed therein for injecting a fluid toward a needle.

In a further embodiment, the fluid line of the presser foot includes a fluid supply passage and a fluid exhaust passage. The fluid supply passage is formed in a length direction at a body of the presser foot and is configured to be connected with a fluid supply device to receive the fluid. The fluid exhaust passage is connected with the fluid supply passage and exhausts the fluid via a needle hole of the body.

In another further embodiment, a thread receiving groove is formed at the needle in a length direction thereof, and the thread receiving groove of the needle faces an upstream side of the fluid line.

An exemplary sewing method according to an embodiment of the present invention includes providing at least one fabric, providing a sheet of synthetic resin material above or below the at least one fabric, and sewing a work material using the presser foot or the sewing machine of the present invention.

In a further embodiment, the sheet of synthetic resin material is a visor core of a cap, and the fabric is a cloth of the cap.

Another exemplary sewing method according to an embodiment of the present invention includes sewing a work material using the presser foot or the sewing machine of the present invention.

In a further embodiment, before sewing the work material, a sheet of synthetic resin material is provided and at least one fabric is provided above or below the sheet of synthetic resin material.

In a still further embodiment, before sewing the work material, the work material is prepared in a shape where the fabric wraps the sheet of synthetic resin material.

DETAILED DESCRIPTION OF THE EMBODIMENTS

An embodiment of the present invention will hereinafter be described in detail with reference to the accompanying drawings.

Figure 1:
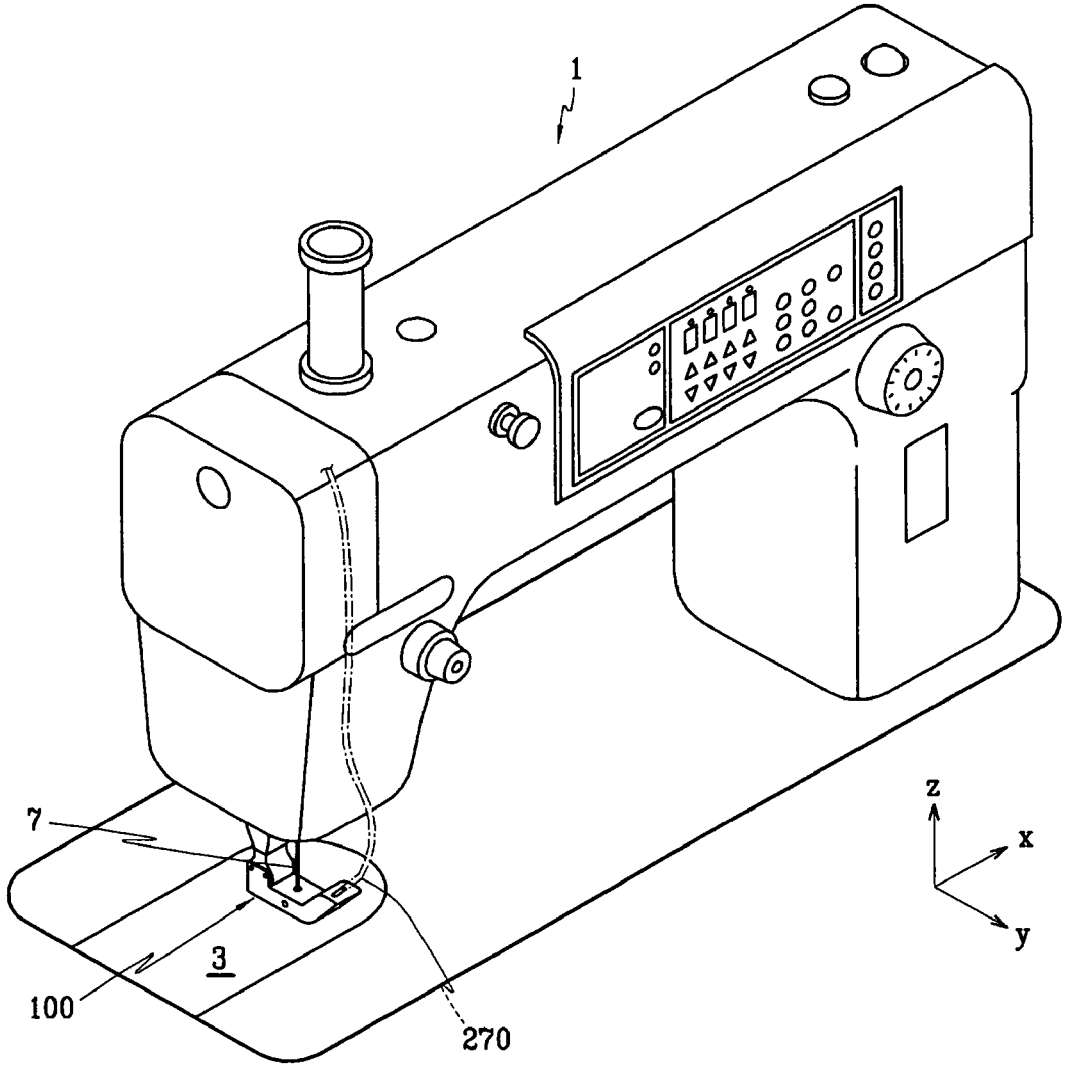
FIG. 1 is a perspective view of a sewing machine according to an exemplary embodiment of the present invention.

FIG. 1 is a perspective view of a sewing machine according to an exemplary embodiment of the present invention. The sewing machine includes a sewing machine head 1 installed with a sewing mechanism, a table 3 on which a work material (refer to FIG. 2 and FIG. 3) is laid and moved while sewing, and a driving apparatus (e.g., a motor) that produces power for the sewing machine.

A needle 7 reciprocally moving in a vertical direction is assembled to the sewing machine head 1 through a needle bar 8 (refer to FIG. 6 and FIG. 8) that enables maintenance and exchange of the needle 7. In addition, the head 1 is provided with a presser foot 100 pressing the work material.

Figure 6:
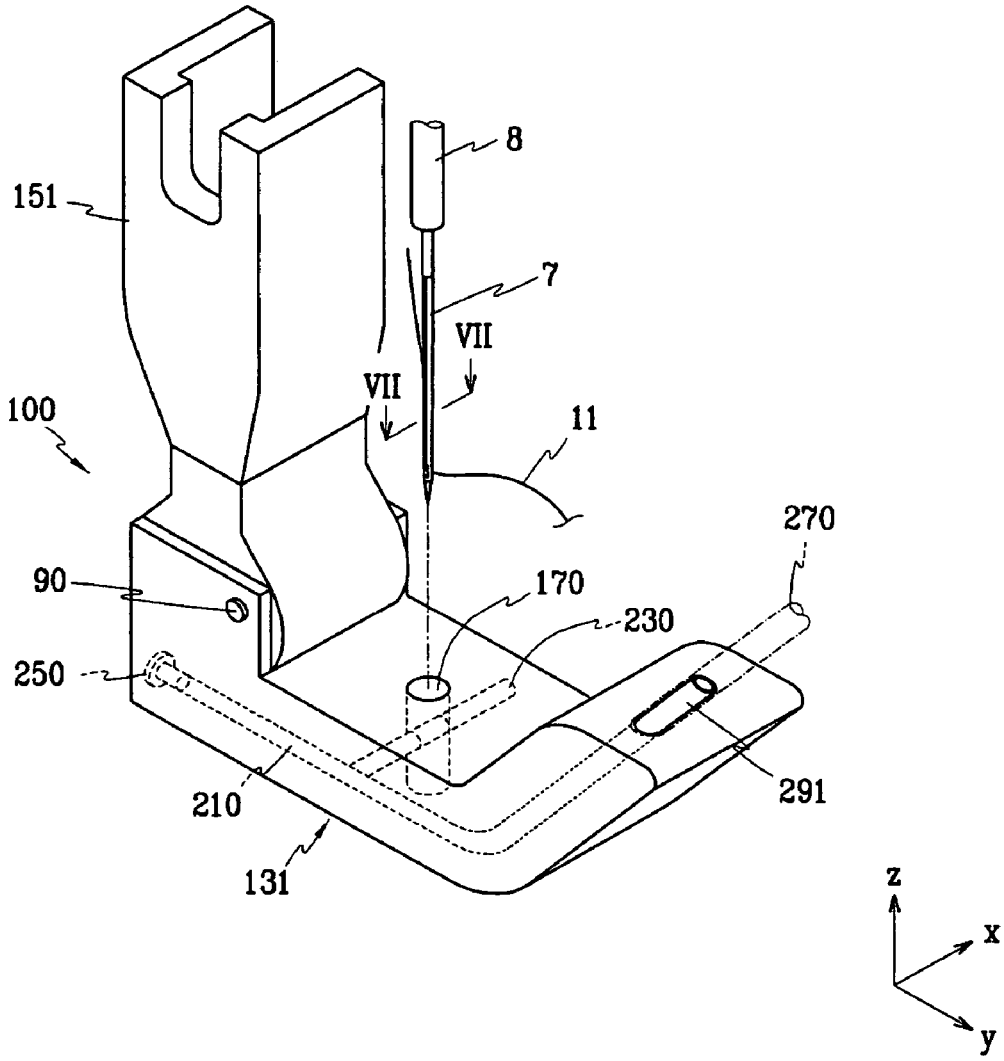
FIG. 6 is a perspective view showing an operation of a presser foot according to an exemplary embodiment of the present invention.
Figure 7:
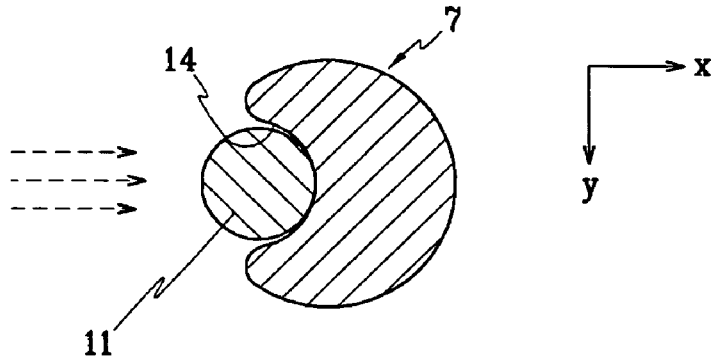
FIG. 7 is a cross-sectional view along the line □-□ of FIG. 6.

As shown in FIG. 6 and FIG. 7, a thread receiving groove 14 for temporarily receiving the upper thread 11 is formed at the needle 7 in a length direction thereof. When the needle 7 penetrates the work material W together with the thread 11, the thread 11 is temporarily aligned with and stored in the thread receiving groove 14. Therefore, the thread 11 therein is protected from breakage, thereby preventing an interruption of the sewing process. Dotted arrows shown in FIG. 7 denote a direction in which the thread 11 is pressed toward the thread receiving groove 14 by the work material W when the thread 11 penetrates the work material W. As will be described later, the direction of the arrows in FIG. 7 is the same as a direction in which a fluid flows toward the needle 7 for cooling it.

The presser foot 100 includes a body 131 and a fixing member 151. The body 131 presses the work material when sewing. The fixing member 151 is hinge-engaged with the body 131 through a hinge pin 90 and is fixed with the head 1.

Figure 2:
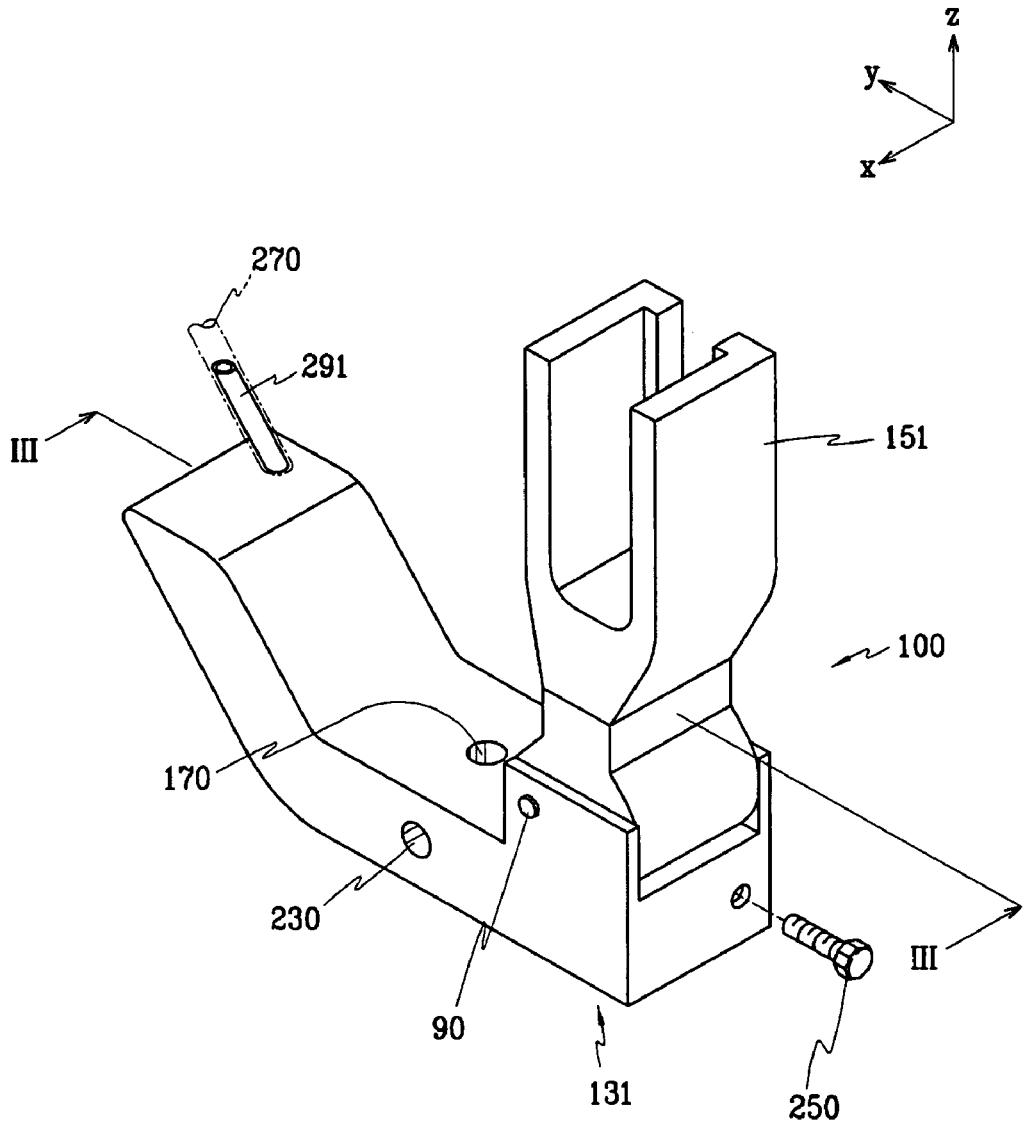
FIG. 2 is a perspective view of a presser foot according to a first exemplary embodiment of the present invention.

A configuration of the presser foot 100 will hereinafter be described in detail with reference to FIG. 2, FIG. 3, and FIG. 4. A needle hole 170 is formed at the presser foot 100 such that the needle 7 may pass therethrough in order to sew the work material W. The needle hole 170 is formed as a hole penetrating the body 131 in a vertical direction (i.e., z-axis direction shown in FIG. 2). However, the shape of the needle hole 170 is not necessarily limited thereto, and to the contrary, the needle hole 170 may be formed in any shape to form a passage for the needle 7 to sew the work material W.

A fluid line is formed at the body 131 such that a fluid, such as a cold air received from a compressor (not shown) or a fan, may be injected to the needle hole 170 through the fluid line. Hereinafter, the fluid line is also called an air line since air is used as an example of the fluid in the exemplary embodiments of the present invention. The fluid line includes a fluid supply passage 210 (hereinafter, also called an "air supply passage") and a fluid exhaust passage 230 (hereinafter, also called an "air exhaust passage"). The fluid supply passage 210 is formed penetrating through the body 131 in the length direction (i.e., a y-axis direction shown in the drawings) thereof and intersecting the needle hole 170. The fluid exhaust passage 230 also intersects the needle hole 170 and it exhausts the fluid received at the needle hole 170 from the fluid supply passage 210.

Figure 3:
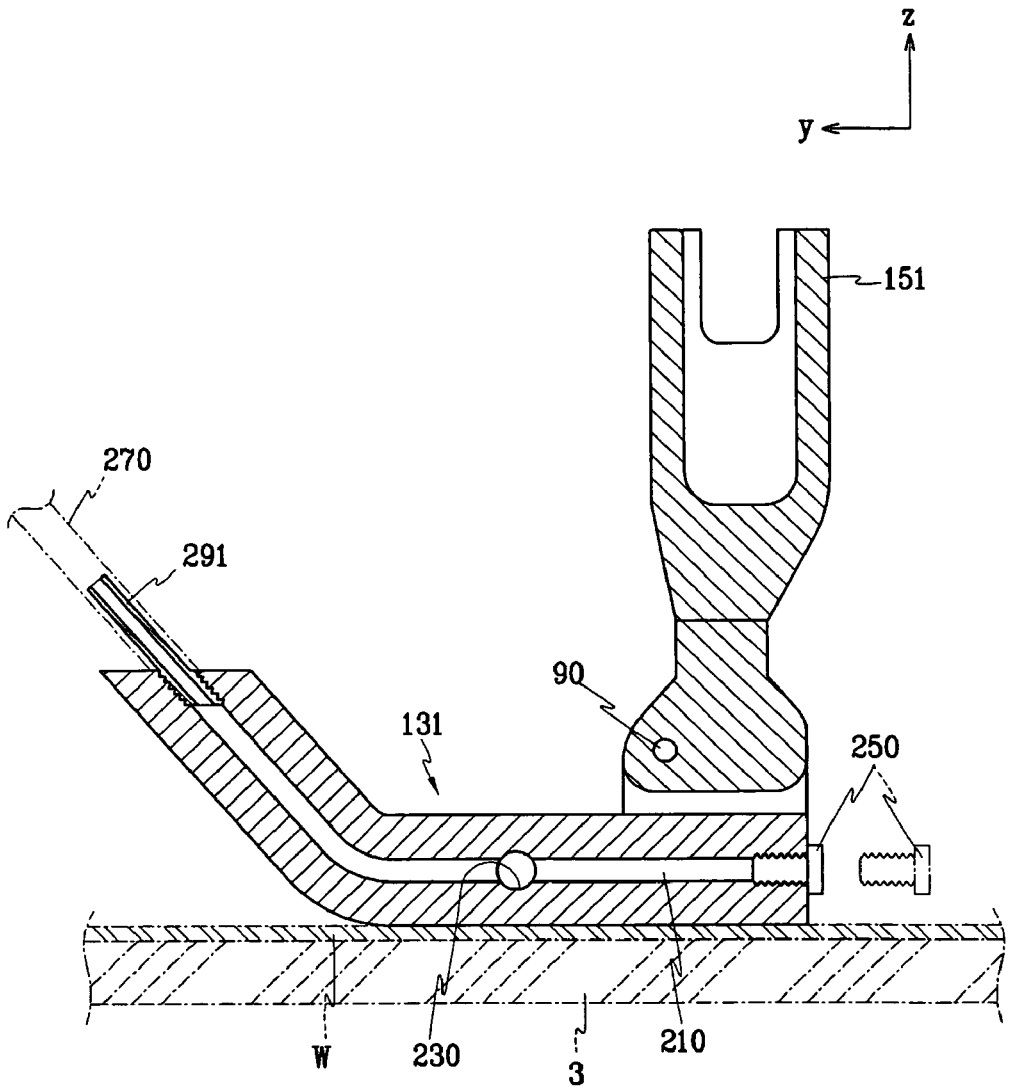
FIG. 3 is a cross-sectional view along the line □-□ of FIG. 2.

In accordance with the structural feature of the presser foot 100 having a bent portion, the fluid supply passage 210 according to an exemplary embodiment of the present invention may be curvedly formed through the bent portion as shown in FIG. 3.

One end of the fluid supply passage 210 is closed, e.g., by plugging it with a screw 250, and the other end thereof is connected with a fluid supply device 310 (refer to FIG. 5) through a line member 270 (for example, a hose of transparent synthetic resin material). In more detail, a connection member 291 is interconnected between the fluid supply passage 210 and the line member 270 such that their connection may become easier and firmer. One end of the connection member 291, which is to be engaged with the fluid supply passage 210, is formed of threads such that the connection member 291 may be screw engaged with the fluid supply passage 210. The line member 270 may be connected with the connection member 291 by a tight fitting.

The fluid supply device 310 may be realized as a compressor compressing an air or as a fan supplying a cooled air. Although air is used as a coolant in an embodiment of the present invention, other gases may also be used for cooling the needle 7.

Figure 4:
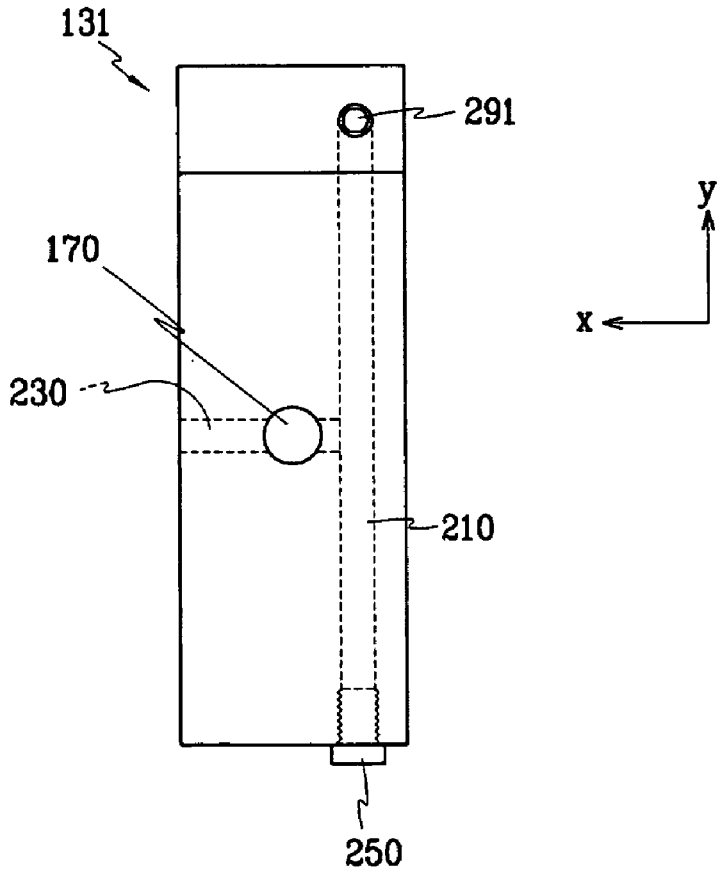
FIG. 4 is a schematic top plane view of the presser foot shown in FIG. 2.

Referring to FIG. 4, the fluid supply passage 210 is formed in the y-axis direction at a biased position in a width direction (i.e., an x-axis direction in the drawings) of the body 131 of the presser foot 100. The fluid exhaust passage 230 connected with the fluid supply passage 210 is formed in the x-axis direction and penetrates the needle hole 170 formed at the body 131.

The fluid (e.g., a compressed air) received through the fluid supply passage 210 is injected to the needle hole 170 through the fluid exhaust passage 230. Therefore, although the needle 7 is heated by friction with the work material W while moving at a high speed, it may be cooled by the injected fluid.

Figure 5:
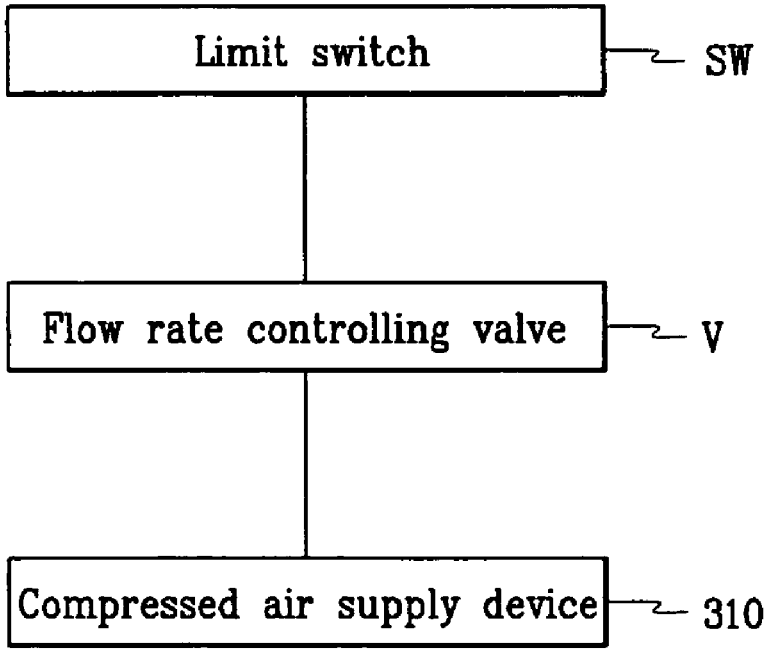
FIG. 5 is a block diagram of a mechanism for supplying compressed air in a sewing machine according to exemplary embodiments of the present invention.

On the other hand, the fluid supply device 310 may be connected with the fluid supply passage 210 through a valve V that is controlled by a switch SW (refer to FIG. 5). The switch SW may be realized as a limit switch operated according to an operation of the driving apparatus (not shown), or alternatively, it may be switched on and off by a switching device. The valve V may be controlled on and off by an operation of the switch SW, and a speed controller may be further provided so as to control a flow rate of the fluid (e.g., a compressed air).

According to the first exemplary embodiment of the present invention, the fluid line formed at the body 131 of the presser foot 100 is dividedly formed by the fluid supply passage 210 and the fluid exhaust passage 230. However, the present invention is not limited thereto, and an exemplary variation of the first embodiment will hereinafter be described in detail.

Figure 8:
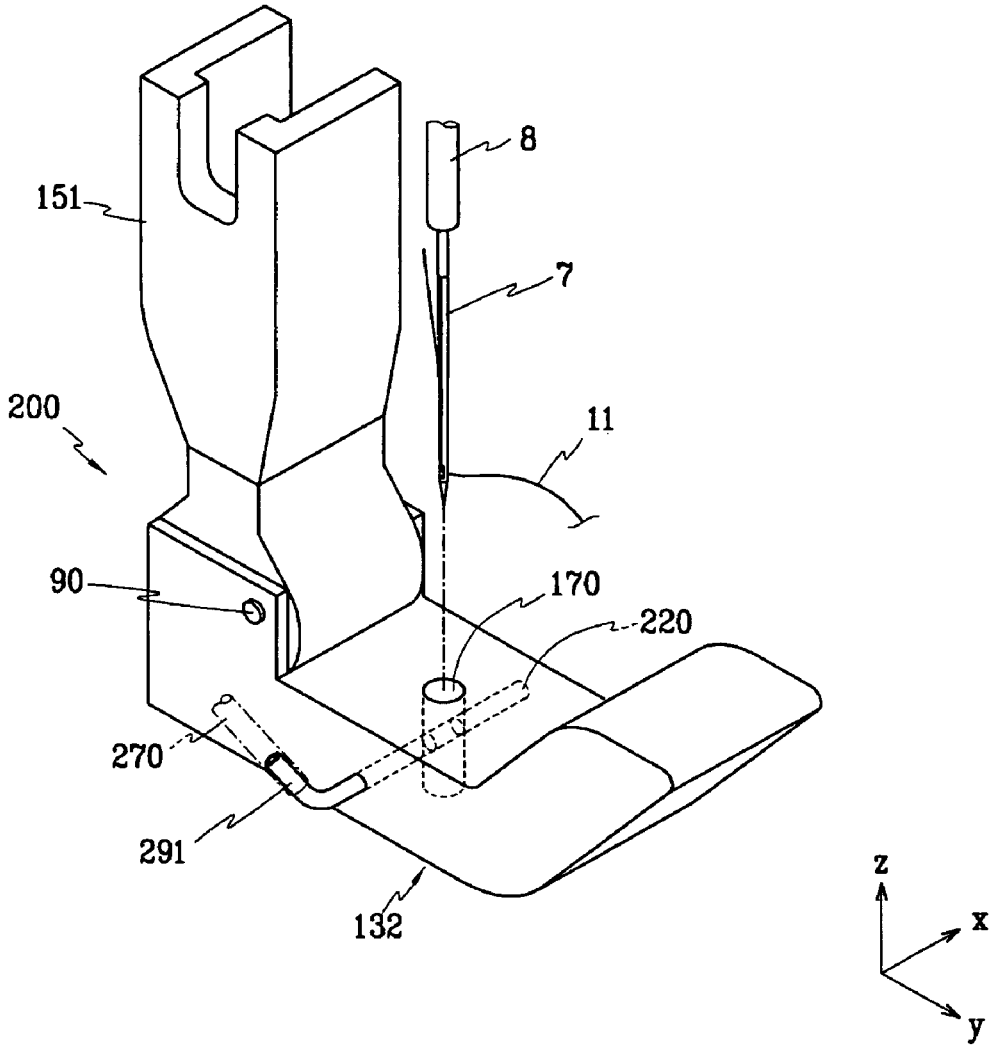
FIG. 8 is a perspective view of a presser foot according to a second exemplary embodiment of the present invention.

As shown in FIG. 8, a fluid line 220 is formed in the x-axis direction through a body 132 of the presser foot 200 crossing between opposite lateral sides of the body 132 such that the fluid may be injected directly to the needle hole 170. The fluid line 220 is connected with the line member 270 through a connection member 291, and the fluid, such as compressed air, is supplied to the needle hole 170 through the fluid line 220. Such a second exemplary embodiment is an example of variations of the first embodiment, and enables cooling of the needle by a simpler configuration of the presser foot. In the above description of the second exemplary embodiment of the present invention, elements and features that are the same as in the first embodiment may be referred to as in the description described in connection with the first embodiment.

According to the above described schemes, a needle moving at a high speed during the operation of a sewing machine may be cooled by a fluid (e.g., compressed air) injected to the needle.

Hereinafter, an operation of the sewing machine and a sewing method according to an exemplary embodiment of the present invention will be described in detail.

An operator lays a work material (for example, a cap manufactured by sewing a visor core made of a synthetic resin material that is thermally weak) on the table 3, and starts the driving apparatus. In more detail, a sheet of a synthetic resin material forming the visor core of the cap is firstly laid on the table. Then, a fabric is disposed to simply cover the synthetic resin material sheet or to wrap it, and the driving apparatus is started. Here, the fabric may be a cloth.

Then, the needle 7 inserted with the upper thread starts its vertical movement for the sewing. At the same time, the switch SW is turned on to open the on/off valve V, and thus, the fluid (e.g., compressed air) of the fluid supply device 310 is flowed into the fluid supply passage 210 via the line member 270. The fluid flowed into the fluid supply passage 210 is exhausted through the fluid exhaust passage 230, passing through the needle hole 170 of the body 131. In this case, the needle 7 reciprocates in the needle hole 170, and thus it is rapidly cooled by the fluid.

The thread receiving groove 14 of the needle 7 may be formed at a position facing an upstream side of the fluid exhaust passage 210 such that the fluid is injected toward the thread receiving groove 14. Accordingly, the thread 11 (i.e., the upper thread) is not waved by the fluid but securely remains in the thread receiving groove 14. Therefore, the sewing may be maintained stable and fine since the thread 11 minimally interferes with the working material W and thus it is protected from friction therebetween. Therefore, defects of the sewn products are further prevented and a higher quality of the products may be obtained due to such a feature in addition to preventing local melting of the work material by the hot needle and protecting the sewn product from the leavings of the melted bits of the work material.

In a more specific example, when a visor core (which is typically made of a thermally weak material) is sewed to manufacture a cap, the needle 7 is rapidly cooled so as to prevent heating of the needle 7 above a predetermined level, and thus the melting of the visor core due to a hot needle may be prevented. Therefore, high quality products may be continuously manufactured, and thus improvement of quality and productivity may be achieved.

In the above specific example, the present invention is exemplified in the sewing of the visor core that is usually made of a thermally weak material, however, it will be understood that the present invention is not limited thereto. It may also be exemplified in stitches used for sewing a protection member of a thermally weak material in the front of a crown portion of a cap.

Figure 9:
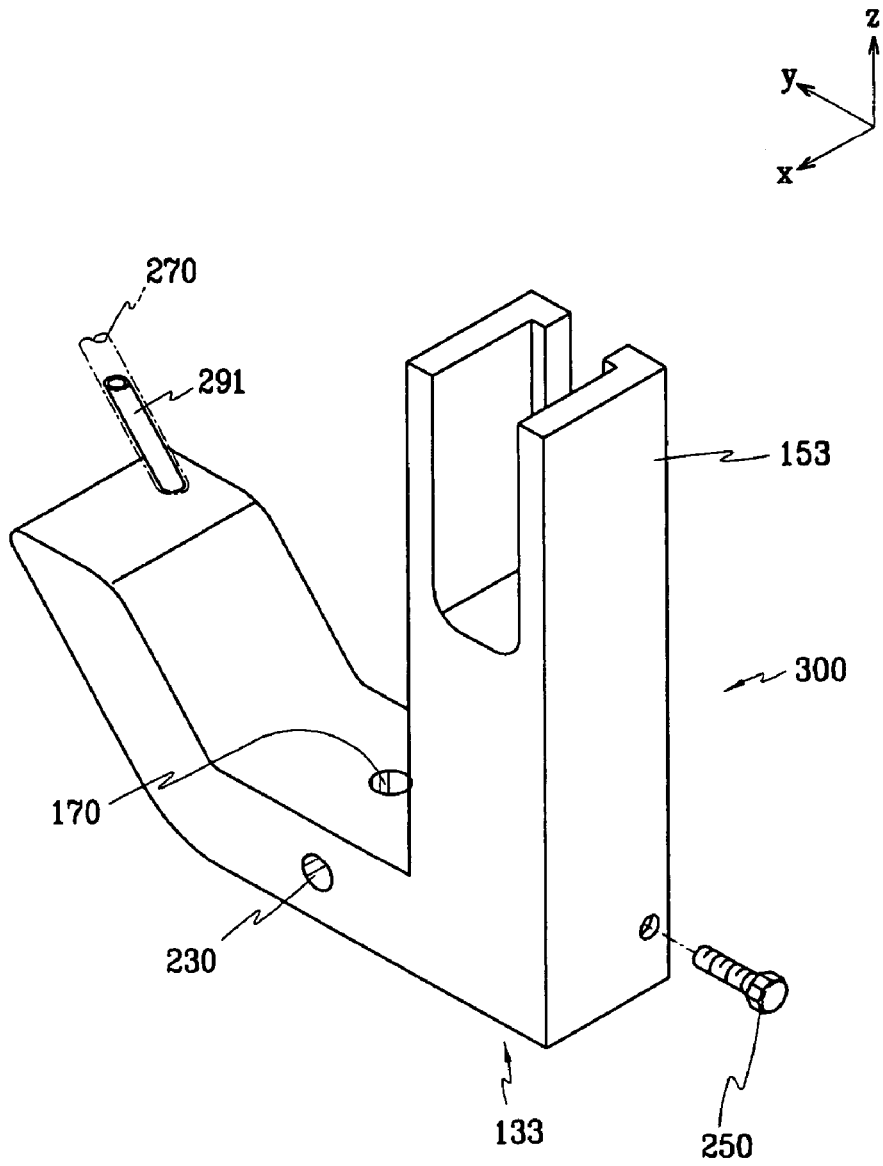
FIG. 9 is a perspective view of a presser foot according to a third exemplary embodiment of the present invention.

FIG. 9 is a perspective view of a presser foot 300 according to a third exemplary embodiment of the present invention.

The presser foot 300 according to the third exemplary embodiment of the present invention is similar to the above-described presser feet 100 and 200, and thus only the differences therefrom will be focused on in the following description.

According to the first and second exemplary embodiments, the fixing member 151 is hinge-engaged with the body 131 and 132 of the presser feet 100 and 200. However, according to the third exemplary embodiment of the present invention, a body 133 of the presser foot 300 is integrally formed with a fixing member 153. That is, the fixing member 153 is formed as an extension of the body 133, and the presser foot 300 is fixed to the head 1 by the fixing member 153. According to such a third exemplary embodiment of the present invention, the presser foot 300 may be manufactured by a simpler process and a manufacturing cost thereof may be decreased by reducing the number of parts in the presser foot 300.

Such a presser foot 300 according to the third exemplary embodiment is an example of the variety of variations of presser foot included within the spirit of the present invention.

Figure 10:
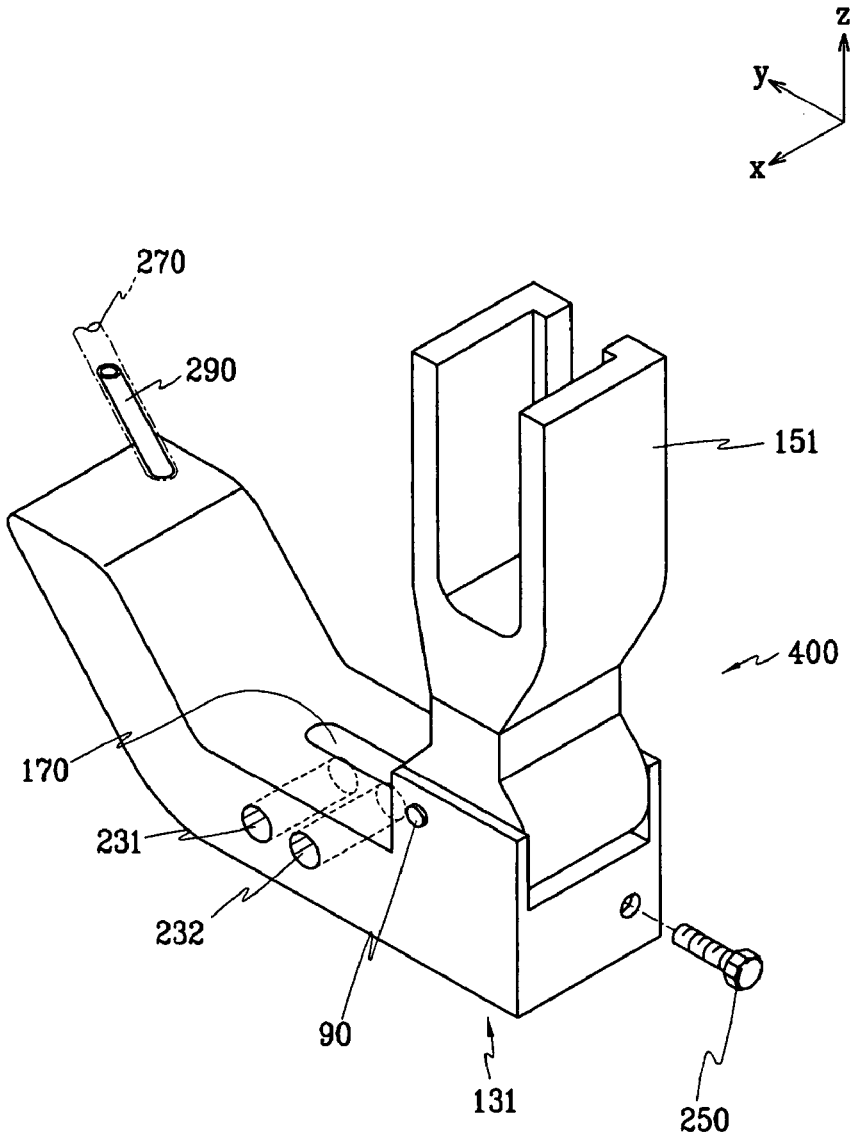
FIG. 10 is a perspective view of a presser foot according to a fourth exemplary embodiment of the present invention.

Referring to FIG. 10, a fourth exemplary embodiment of the present invention will be explained.

The presser foot 400 according to the fourth exemplary embodiment of the present invention is similar to the above-described presser feet 100-300, and thus only the differences therefrom will be focused on in the following description.

According to the first to third exemplary embodiments, the presser foot has one air exhaust passage. However, according to the fourth exemplary embodiment of the present invention, a presser foot 400 has two air exhaust passages 231 and 232. The two air exhaust passages 231 and 232 provide large space for rapid exhaust of air. Further, passages 231 and 232 can reduce noises which are generally produced when fluid with high pressure is exhausted through a narrow outlet.

It should be noted that a presser foot according to the present invention may has two or more fluid exhaust passages according to a desired design of the presser foot. Further, the presser foot may be modified in various shapes.

As described above, according to embodiments of the present invention, a needle used for sewing a work material is cooled by a fluid, such as compressed air, and melted leavings from the work material, which is a thermally weak material, may be prevented from staining the sewn product. Therefore, the quality and productivity of a sewn product may be enhanced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A presser foot, comprising:

a body having a needle hole providing a passage for a needle;

a fixing member formed at the body and configured to combine with a sewing machine;

a fluid line formed at the body for injecting a fluid toward the needle; and a thread receiving groove is formed at the needle in a length direction thereof and the thread receiving groove of the needle faces an upstream side of the fluid line.

2. The presser foot of claim 1, wherein the fluid line comprises:

a fluid supply passage formed in a length direction at the body and configured to be connected with a fluid supply device to receive the fluid; and at least one fluid exhaust passage connected with the fluid supply passage and exhausting the fluid via the needle hole of the body.

3. The presser foot of claim 1, wherein a connection member is mounted at the fluid line such that a line member from a fluid supply device may be connected with the fluid line therethrough.

4. A presser foot, comprising:

a body configured to combine with a sewing machine and having a needle hole providing a passage for a needle;

a fluid line formed at the body for injecting a fluid toward the needle; and a thread receiving groove is formed at the needle in a length direction thereof and the thread receiving groove of the needle faces an upstream side of the fluid line.

5. The presser foot of claim 4, wherein the fluid line comprises:

a fluid supply passage formed in a length direction at the body and configured to be connected with a fluid supply device to receive the fluid; and at least one fluid exhaust passage connected with the fluid supply passage and exhausting the fluid via the needle hole of the body.

6. The presser foot of claim 4, wherein a connection member is mounted at the fluid line such that a line member from a fluid supply device may be connected with the fluid line therethrough.

7. A sewing machine, comprising:

a fluid supply device;

an on/off valve connected with the fluid supply device through a line member;

a switch operating the on/off valve;

a presser foot connected with the on/off valve to receive a fluid therefrom and having a fluid line formed therein for injecting a fluid toward a needle; and a thread receiving groove is formed at the needle in a length direction thereof and the thread receiving groove of the needle faces an upstream side of the fluid line.

8. The sewing machine of claim 7, wherein the fluid line of the presser foot comprises:

a fluid supply passage formed in a length direction at a body of the presser foot and configured to be connected with a fluid supply device to receive the fluid; and at least one fluid exhaust passage connected with the fluid supply passage and exhausting the fluid via a needle hole of the body.

9. A sewing method comprising:

sewing a work material using a presser foot, wherein the presser foot comprises:

a body having a needle hole providing a passage for a needle;

a fixing member formed at the body and configured to combine with a sewing machine;

a fluid line formed at the body for injecting a fluid toward the needle; and a thread receiving groove is formed at the needle in a length direction thereof and the thread receiving groove of the needle faces an upstream side of the fluid line.

10. The sewing method of claim 9, further comprising, before sewing the work material:

providing at least one fabric; and providing a sheet of a synthetic resin material above or below the at least one fabric.

11. The sewing method of claim 9, wherein the sheet of synthetic resin material is a visor core of a cap, and the fabric is a cloth of the cap.

12. The sewing method of claim 10, wherein the work material is prepared in a shape where the fabric wraps the sheet of the synthetic resin material by providing the at least one fabric and providing the sheet of synthetic resin material above or below the at least one fabric.

13. A sewing method comprising:

sewing a work material using a sewing machine of claim 7, wherein the sewing machine comprises:

a fluid supply device;

an on/off valve connected with the fluid supply device through a line member;

a switch operating the on/off valve; and a presser foot connected with the on/off valve to receive a fluid therefrom and having a fluid line formed therein for injecting a fluid toward a needle.

14. The sewing method of claim 13, further comprising, before sewing the work material:

providing a sheet of a synthetic resin material; and providing at least one fabric above or below the sheet of synthetic resin material.

15. The sewing method of claim 13, wherein the sheet of synthetic resin material is a visor core of a cap, and the fabric is a cloth of the cap.

16. The sewing method of claim 14, the work material is prepared in a shape where the fabric wraps the sheet of the synthetic resin material by providing the at least one fabric and providing the sheet of synthetic resin material above or below the at least one fabric.

* * * * *